United States Patent [19]

Christ

[11] 4,430,992

[45] Feb. 14, 1984

[54] TREATMENT APPARATUS

[76] Inventor: Rudolf Christ, Freiherr-von-Drais-Strasse 50, 6801 Neckarhausen, Fed. Rep. of Germany

[21] Appl. No.: 259,052

[22] Filed: Apr. 30, 1981

[51] Int. Cl.[3] ..... A61H 1/00

[52] U.S. Cl. ..... 128/33; 128/46

[58] Field of Search ..... 128/32, 33, 34, 35, 128/36, 37, 42, 43, 45, 47, 48, 49

[56] References Cited

U.S. PATENT DOCUMENTS

| | | | |
|---|---|---|---|
| 726,054 | 4/1903 | Hartford | 128/69 |
| 2,098,211 | 7/1958 | Ware | 128/33 |
| 2,235,183 | 3/1941 | Wettlaufer | 128/33 |
| 3,752,154 | 8/1973 | Clark . | |

FOREIGN PATENT DOCUMENTS

| | | |
|---|---|---|
| 266301 | 11/1968 | Austria . |
| 924891 | 3/1955 | Fed. Rep. of Germany . |
| 1864818 | 10/1962 | Fed. Rep. of Germany . |
| 1290300 | 3/1969 | Fed. Rep. of Germany . |
| 1937829 | 4/1970 | Fed. Rep. of Germany . |
| 333000 | 11/1958 | Switzerland . |
| 733407 | 7/1955 | United Kingdom . |
| 1221089 | 2/1971 | United Kingdom . |
| 1260140 | 1/1972 | United Kingdom . |
| 1321403 | 6/1973 | United Kingdom . |
| 1430014 | 3/1976 | United Kingdom . |
| 1522935 | 8/1978 | United Kingdom . |
| 1581240 | 12/1980 | United Kingdom . |

*Primary Examiner*—Richard J. Apley
*Assistant Examiner*—David J. Braun
*Attorney, Agent, or Firm*—Wenderoth, Lind & Ponack

[57] ABSTRACT

A treatment apparatus which is preferably mounted on a couch for a supine person and has a support surface at least part of which is provided by a resiliently mounted support member which is oscillatable by drive means the frequency and/or stroke of which can be controlled and which can be adjusted selectively to produce a first main component of oscillation at right angles to the support surface and/or a second main component of oscillation in the plane of the support surface.

11 Claims, 2 Drawing Figures

TREATMENT APPARATUS

BACKGROUND OF THE INVENTION

The invention relates to treatment apparatus of the type employed in couches for treating ailments by oscillation or vibration of the body or a part thereof.

Oscillatory couches, whereby mutually displaceable parts of a frame can be repositioned are known in various forms both for simple stress-relief and pain-relief purposes and for the planned orthopaedic treatment of the vertebrae, discs and joints.

Thus French Specification No. 1108031 describes a stretching couch which has a plurality of resiliently mounted oscillating plates on its support surface.

A vibratory support for the therapeutic or toning-up treatment of muscles and joints of the human body is disclosed in British Patent Specification No. 1260140. This is concerned with a couch, on the underside of which is arranged an electric drive motor, which powers a rotary body with an imbalance which can be adjusted and which imparts vibrations to the couch. In addition, a vibrator which can be switched on as required and has an electromagnetic drive is connected to the couch.

Also, a couch for the mechanical extension treatment of the spinal column and its bony connecting members is disclosed in Swiss Patent Specification No. 468183, this couch being swingable and having a vibration table for carrying the body of the patient, and a vibrator for vibrating this plate.

German Patent Specification No. 2713438 discloses apparatus for the treatment of the back and other parts of the human body, which apparatus takes the form of equipment for repositioning slipped discs and for the treatment of reflex zones. For this purpose, an oscillating plate is provided which has a curved supporting surface and is fitted with a number of massage studs. The oscillating plate can be displaced towards the surface of the couch. An electric drive motor, which is provided in conjunction with the resilient backing for the oscillating plate and which engages this plate by way of a crank drive, produces a circulating movement having a main component, substantially in the plane of the supporting surface.

The known forms of vibration-treatment means are capable of improvement, particularly in two respects:

(1) Optional production of main components of oscillation in different planes is not possible.

(2) The arrangement comprising drive motors connected to the oscillating plate or to its resilient mounting has proved to be unsatisfactory as regards oscillating technique and, in the case of drive motors of simple construction that participate in the vibration movements, leads to damage of the couch.

SUMMARY OF THE INVENTION

The object of the present invention is to provide an apparatus for vibration treatment that permits the selective and controllable production of main components of oscillation in various planes with the aid of simple means that are not subject to undue wear.

According to this invention there is provided a treatment apparatus for oscillatory treatment for the body comprising a frame, a support member mounted on the frame and providing a support surface for at least part of the body, and drive means connected to the support member and selectively operable to oscillate the support surface relative to the frame with a main component at right angles to the plane of the support surface, with a main component parallel to the plane of the support surface, or with both a first main component at right angles to the plane of the support surface and with a second main component parallel to the plane of the support surface, the drive means being controllable to adjust the frequency and/or amplitude of the oscillations. Thus, in this arrangement, it is possible to obtain the known directions of the main components individually or in combination and in accurate mutual relationship. A vibratory movement can be set up wherein lateral oscillating movement in the plane of the support surface is combined, in a manner promoting successful treatment, with vertical oscillating movement at right angles to the surface.

A particularly useful construction, wherein advantageous distribution of mass and damping as well as avoidance of damage to the bearings of motors of the drive means are achieved, can be provided if the drive means each incorporate a motor which is connected by way of a resilient drive connection to an associated oscillation generator mounted on the support member. The separation of the drive motor and the oscillation generator and their interconnection only by a resilient intermediate member extends the range of application and the possibilities for setting the apparatus. An arrangement that appears to offer advantage is that wherein the drive motors are fitted on a fixed frame part on which the oscillating support member is resiliently mounted. Advantageously, the drive motors are separately controllable.

The oscillation generator may conveniently take the form of a rotatable part which is out of balance. Other possible drive means could be constituted by pneumatic vibratory drives or electro-magnetic oscillating armature drives.

It has been found in practice that a simple and advantageous drive connection between the drive motors and the parts which rotate out of balance can be achieved by means of grooved pulleys in combination with resilient drive belts. The drive belts are required to have a relatively high degree of resilience to achieve sufficient initial tightness with sufficient deflection during the vibration operation.

In a further arrangement that may be expedient in some circumstances, the resilient drive connection is a helical resilient shaft, which is moved along an arcuate path, or a solid or hollow shaft of resilient material. The arcuate movement avoids direct transmission of vibrational impacts to the bearings of the drive motor.

In an arrangement which is advantageous from the design point of view, bearings are provided on the support member and carry spindles at right angles to each other for mounting pulleys in conjunction with a rotary eccentric weight. If a belt drive is used it becomes possible, if required, to mount the pulleys together with the weights, which may be integral therewith, in the corresponding bearing and to connect them by way of the belts to the associated drive motors. If a main component is not required, the belts for this drive can be removed, and thus the drive motor, while stopped, can be completely relieved of the vibratory movement derived from the support member.

A further advantage may be achieved if the support surface is bent in cross-section, and a recess for accommodating the spinal column of a supine person can be advantageously formed in the zone of the longitudinal axis of the support surface.

It is thus possible to adjust the support surface of the couch in all directions as regards its main components, and in addition there results a general arrangement which is of simple design, is reliable, and can be used both as a part for adding to existing couches and as an original integral fitment.

BRIEF DESCRIPTION OF THE DRAWINGS

An embodiment of the apparatus of the invention is illustrated diagrammatically in the accompanying drawings, in which.

DETAILED DESCRIPTION OF THE INVENTION

Figure 1:
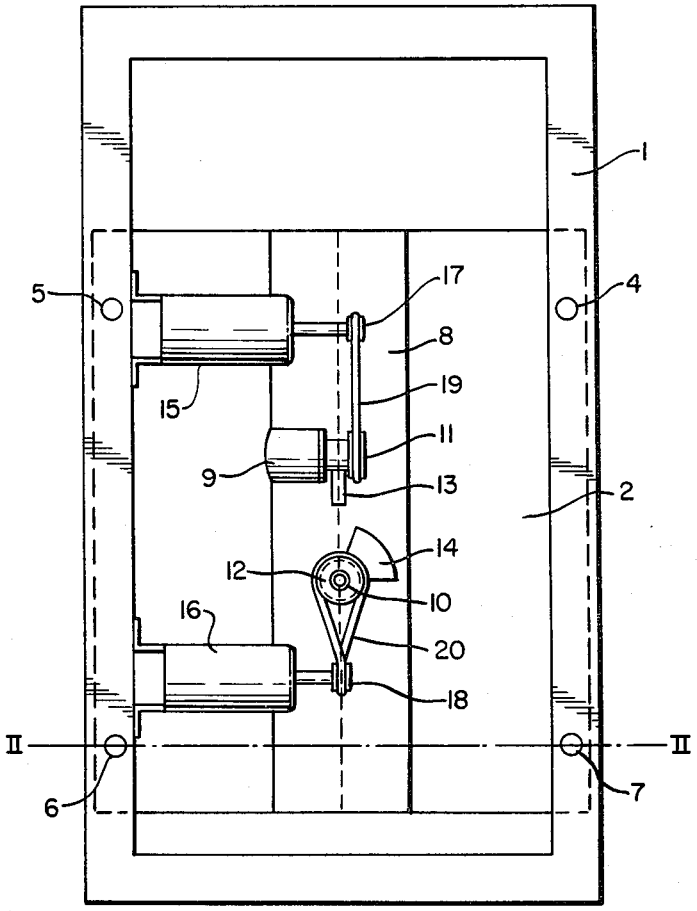
FIG. 1 is, on a reduced scale, a bottom view of treatment apparatus which can be used as an additional or integral part of a couch.
Figure 2:
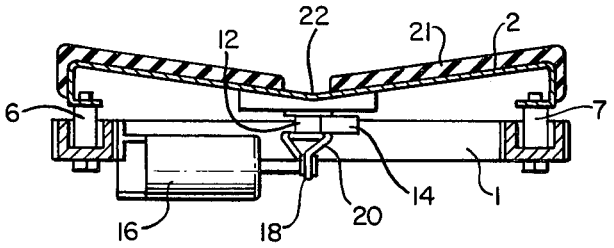
FIG. 2 is a section along line II—II of FIG. 1.

Secured to a frame part 1, illustrated in FIG. 1, is a rectangular support member 2 which, as shown in FIG. 2, has portions thereof, on opposite sides of a longitudinal centre line, inclined towards each other.

The member 2 is mounted in soft elastic bearings 4, 5, 6 and 7, which permit suitable displacement in the required component directions. The bearings 4, 5, 6 and 7 are fitted in the frame part 1. Provided at the lower face of the member 2 is a reinforcing support 8 which carries two bearings 9 and 10 for supporting drive wheels 11 and 12 in conjunction with eccentric unbalancing weights 13 and 14. In the illustrated arrangement, the weights 13 and 14 are formed integrally with the drive wheels 11 and 12; however, they can also be formed separately and may be replaceable as sets. The unbalancing weights 13 and 14 in conjunction with the drive wheels 11 and 12 form oscillation generators which are arranged on the member 2.

Electric drive motors 15 and 16 are mounted on the frame part 1 and are connected to the drive wheels 11 and 12 of the oscillation generators by way of grooved wheels 17 and 18 and resilient drive belts 19 and 20. Since the two bearings 9 and 10 have their axes at right angles to each other, a first main component of oscillation at right angles to the support surface is generated by unbalancing weight 13 and a second main component of oscillation in the plane of the support surface is generated by unbalancing weight 14.

The member 2 carries a resilient cushion 21, which has, in the zone of the line along which the plate 2 is bent, a channel-like recess 22 for accommodating the vertebral column of a person undergoing treatment. The cushion 21 may if desired have some other shape adapted to accommodate part of the body.

Switching elements, which can be actuated by the hand or foot may be provided on the frame part, so that the person undergoing treatment can automatically control, by means of these switching elements, the components of oscillation by altering the speed of the drive motors 15 and 16. In addition, or alternatively, a remote-control means for use by an operator may be provided.

Instead of an arrangement involving lines of action of the main components that are at right angles to each other, it may be advantageous to use a system providing other angular positions of these components in relation to each other and to the supporting surface.

The upper face of the cushion 21 may advantageously be roughened, since in this way oscillations can be transferred more efficiently to the body of the person undergoing treatment.

I claim:

1. A treatment apparatus for oscillatory treatment of the body of a patient, said apparatus comprising:

frame means;

a support member resiliently mounted on said frame and defining a support surface for at least a part of the body of a patient;

rotary eccentric weight oscillation generating means on said support member and selectively operable for generating a first rotating oscillation component extending in a first plane and applying said first oscillation rotating component to said support surface for oscillating said support surface relative to said frame and for generating a second rotating oscillation component extending in a second plane different from and non-parallel to said first plane and applying said second rotating oscillating component to said support surface for oscillating said support surface and in combination with the first oscillating rotating component, producing oscillations of said support surface ranging from a reciprocal oscillation of said support surface in said first plane to a reciprocal oscillation in said second plane and including complex three dimensional oscillations of said support surface which are resultants of said oscillations in said first and second planes;

drive means on said frame flexibly connected to said oscillation generating means, said drive meas being adjustable to vary independently at least one of the frequency and amplitude of said first component and at least one of the frequency and amplitude of said second component for varying said oscillating rotating components to produce said reciprocal and said complex oscillations.

2. An apparatus as claimed in claim 1, wherein said first plane extends generally parallel to the plane of said support surface, and said second plane extends generally perpendicular to said support surface.

3. An apparatus as claimed in claim 1, wherein the drive means comprises first and second oscillation generators mounted on said support member, first and second drive motors mounted on said frame, and first and second flexible drive connections between respective said motors and respective said oscillation generators.

4. An apparatus as claimed in claim 3, wherein each said resilient drive connection comprises a resilient drive belt.

5. An apparatus as claimed in claim 3, wherein each said resilient drive connection comprises a helicalspring shaft.

6. An apparatus as claimed in claim 3, wherein each said resilient drive connection comprises a shaft of resilient material.

7. An apparatus as claimed in claim 3, wherein said oscillation generators comprise first and second pulleys rotatably mounted on said support member with their respective axes of rotation respectively generally parallel to and at right angles to the plane of said support surface, and respective rotary eccentric weights connected to said pulleys to be driven thereby to generate said oscillation components.

8. An apparatus as claimed in claim 1, wherein the portions of the support surface at opposite sides of the longitudinal axis thereof are inclined towards each other.

9. An appratus as claimed in claim 8, wherein said support surface has formed along said longitudinal axis a recess for accommodating the vertebral column of the body of the patient.

10. An apparatus as claimed in claim 3, wherein each said motor includes separate control means, whereby a person on said apparatus is able to control independently said oscillation components.

11. An apparatus as claimed in claim 1, wherein said support member is supported elastically on said frame.

* * * * *